US007936306B2

(12) United States Patent
Mierke et al.

(10) Patent No.: US 7,936,306 B2
(45) **Date of Patent: *May 3, 2011**

(54) MULTILAYER ANTENNA ARRANGEMENT

(75) Inventors: Frank Mierke, München (DE); Gerald Schillmeier, München (DE); Thomas Lankes, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 437 days.

This patent is subject to a terminal disclaimer.

(21) Appl. No.: 12/236,181

(22) Filed: Sep. 23, 2008

(65) Prior Publication Data

US 2010/0073236 A1 Mar. 25, 2010

(51) Int. Cl.
*H01Q 1/38* (2006.01)

(52) U.S. Cl. ..... 343/700 MS; 343/711; 343/713

(58) Field of Classification Search ..... 343/700 MS, 343/711, 713

See application file for complete search history.

(56) References Cited

U.S. PATENT DOCUMENTS

| | | | | |
|---|---|---|---|---|
| 5,880,694 | A * | 3/1999 | Wang et al. | 343/700 MS |
| 6,087,990 | A | 7/2000 | Thill et al. | |
| 6,825,803 | B2 | 11/2004 | Wixforth et al. | |
| 6,836,247 | B2 | 12/2004 | Soutiaguine et al. | |
| 6,850,191 | B1 | 2/2005 | Thill et al. | |
| 6,946,995 | B2 * | 9/2005 | Choi et al. | 343/700 MS |
| 6,995,709 | B2 * | 2/2006 | Spittler | 343/700 MS |
| 7,034,758 | B2 | 4/2006 | Haidacher et al. | |
| 7,187,328 | B2 * | 3/2007 | Tanaka et al. | 343/700 MS |
| 7,253,770 | B2 | 8/2007 | Yegin et al. | |
| 7,432,862 | B2 | 10/2008 | Heyde | |
| 7,489,280 | B2 * | 2/2009 | Aminzadeh et al. | 343/713 |
| 2004/0027284 | A1 | 2/2004 | Leeper et al. | |
| 2005/0116875 | A1 | 6/2005 | Yuanzhu et al. | |
| 2005/0219131 | A1 | 10/2005 | Haidacher et al. | |
| 2008/0218418 | A1 | 9/2008 | Gillette | |

FOREIGN PATENT DOCUMENTS

| | | | |
|---|---|---|---|
| DE | 10037386 | A1 | 2/2002 |
| DE | 102004035064 | A1 | 2/2006 |
| DE | 102005054286 | A1 | 5/2007 |

(Continued)

OTHER PUBLICATIONS

O. Pigaglio, N. Raveu and O. Pascal, "Design of Multi-frequency band Circularly Polarized Stacked Microstrip Patch Antenna," IEEE Antennas and Propagation Society International Symposium, DOI 10.1109/APS.2008.4619109 (Jul. 5-11, 2008).

(Continued)

*Primary Examiner* — Douglas W Owens
*Assistant Examiner* — Dieu Hien T Duong
(74) *Attorney, Agent, or Firm* — Nixon & Vanderhye PC

(57) ABSTRACT

A multilayer antenna arrangement is distinguished in particular by the following features: a further patch antenna (B) comprising a dielectric carrier and a radiation plane is provided above the base portion or central portion of the patch arrangement, the radiation plane being provided on the upper side, opposite the base portion or central portion, of the dielectric carrier, and the further patch antenna (B) is buried at least in part in the parasitic patch arrangement, which is configured so as to be box-shaped or box-like, and/or the parasitic patch arrangement which is configured so as to be box-shaped or box-like is formed, completely or in part, as electrically conductive planes, which are provided on the further patch antenna (B) at least in partial regions on the circumferential edge surface or outer surface thereof.

15 Claims, 8 Drawing Sheets

FOREIGN PATENT DOCUMENTS

| | | | |
|---|---|---|---|
| DE | 10 2006 027 694 | | 9/2007 |
| EP | 0279050 | B1 | 4/1993 |
| EP | 1619752 | A1 | 1/2006 |
| EP | 1 616 367 | | 1/2007 |
| EP | 1793451 | A1 | 6/2007 |
| WO | 2007/144104 | | 12/2007 |

OTHER PUBLICATIONS

Nasimuddin, Karu P. Esselle, and A. K. Verma, "Wideband High-Gain Cicrularly Polarized Stacked Microstrip Antennas With an Optimized C-Type Feed and a Short Horn," IEEE Transactions on Antennas and Propagation, Bd. 56, Nr. 2, 578-581 (Feb. 2008).

Examination Report issued in corresponding German patent application 10 2008 048 289.7-55 (Sep. 22, 2008).

Anguera, Jaume, et al., "Stacked H-Shaped Microstrip Patch Antenna," IEEE Transactions on Antennas and Propagation, vol. 52, No. 4, pp. 983-993 (Apr. 2004).

Moussa, Ismael K., et al., "Analysis of Stacked Rectangular Microstrip Antenna," 24th National Radio Science Conference (NRSC 2007), Faculty of Engineering, Ain shams Univ., Egypt (Mar. 13-15, 2007).

First examination report issued by the German Patent Office in corresponding German patent application (Feb. 10, 2009).

Search Report issued by European Patent Office in corresponding PCT application PCT/EP2009/002234 (Aug. 7, 2009).

* cited by examiner

MULTILAYER ANTENNA ARRANGEMENT

The invention relates to a multilayer antenna arrangement, in particular of a planar construction, in accordance with the preamble of claim 1.

A conventional multilayer antenna is known from DE 10 2006 027 694 B3.

The multilayer antenna of a planar construction known from this publication comprises an electrically conductive ground plane, a conductive radiation plane (which is arranged parallel to the ground plane at a distance therefrom) and a dielectric carrier, which is provided so as to be sandwiched between the ground plane and the radiation plane. Above the radiation plane a carrier means is arranged, on which an electrically conductive patch element is positioned. The carrier means for the patch element has a thickness or height which is less than the thickness or height of the patch element.

The patch element itself can be formed as a three-dimensional body, i.e. as a solid material. It is also possible for the patch element to consist of a metal plate or a metal sheet, which is provided, by cutting or punching for example, with circumferential webs, rims or the like, extending away from the dielectric carrier.

An antenna of this type is suitable in particular as a motor vehicle antenna, for example also for SDARS. For this purpose, a patch antenna of this type can be arranged on a common base arrangement alongside further emitter antennae for other services.

An antenna arrangement of this type, with a plurality of antennae which are disposed under a common hood, is known for example from EP 1 616 367 B1.

From the above-mentioned prior publication, a multifunctional antenna is known which comprises a base, on which four different antennae are arranged offset from one another in a longitudinal direction and are covered by a hood covering all the antennae. This is only one example of an antenna arrangement, in which four different antennae are used. In many cases, however, in a deviation therefrom, antenna arrangements are also required which need for example only one antenna means for SDARS and for example a further patch antenna for determining the geoposition, i.e. an antenna which is often referred to in short as a GPS antenna, independently of what principle they are based on and/or which operators these systems are provided by (the GPS positioning system, the Galileo system etc. are known).

An improved patch antenna which is superior to earlier antennae, in particular for receiving SOARS or comparable services broadcast by satellite and/or terrestrially at the same time, is known from the category-defining DE 10 2006 027 694 B3, which was mentioned at the outset.

If a patch antenna of this type is for example used with a further patch antenna provided for the GPS service, this basically results in a construction of the type which can be seen in FIG. 1 in a schematic vertical cross-sectional view.

FIG. 1 shows an antenna comprising a generally electrically conductive base S, shown only schematically in FIG. 1, which is located below and is covered by a hood H, which allows electromagnetic radiation to pass through, whereby the antennae disposed in the interior of the hood H are protected.

In this case, an improved multilayer antenna A is shown in a schematic cross-sectional view and has a construction of the type which is known for example from DE 10 2006 027 694 B3, which was mentioned at the outset and corresponds to WO 2007/144104 A1.

Additionally, in the antenna arrangement shown in FIG. 1 in a simplified horizontal vertical section, a second antenna B is conventionally provided before the arrangement is fitted on a vehicle in the direction of travel, i.e. a conventional patch antenna, which comprises a ground plane M located below, a patch plane R vertically thereabove and at a distance therefrom, and a dielectric substrate D in between. This patch antenna is, as is known, fed by a feeder L, which leads to the patch plane P from below through the ground plane M and the substrate D via a hole, and is attached galvanically to the patch plane R. The substrate D in this case preferably consists of ceramic, a material with a high dielectric constant.

The object of the present invention is thus to improve an antenna arrangement of this type, optionally of a basic type which uses further antennae for further services (for example mobile communication services in various frequency ranges, etc.).

According to the invention, the object is achieved according to the features specified in claim 1. Advantageous embodiments of the invention are given in the sub-claims.

A surprising solution is provided in the scope of the invention whereby an antenna arrangement, which is comparable with the antenna arrangement of FIG. 1, but which has a much more compact construction than the example of FIG. 1, is produced.

In the solution according to the invention it is proposed that as regards the antenna, the additional patch antenna B shown in FIG. 1 is arranged in a (passive or parasitic) conductive patch element, which is arranged above the radiation plane of a first or primary patch antenna and at a distance therefrom, and which at least in portions is provided with a circumferential rim or wall which extends away from the radiation plane of the antenna A.

In other words, the additional, second or secondary patch antenna, provided for example for GPS services, is positioned in the parasitic patch element, which is configured so as to be box-shaped or box-like and which is arranged, in relation to the first antenna A, above the associated radiation plane.

It is possible for part of the height of the further patch antenna to be buried in the box-shaped or box-like element. The upper side thereof may project over the circumferential rim of the box-shaped or box-like patch element of the first antenna.

However, it is also possible for the at least partial circumferential rim of the parasitic patch element of the first patch antenna to end above the surface of the further patch element, in such a way that the additional patch antenna is completely buried in the receiving space of the patch element which is provided with a circumferential rim or with circumferential rim portions.

The further patch antenna, provided in particular for GPS services, can in this case rest on and/or be fastened on the parasitic box-shaped or box-like patch element of the first patch antenna, with the interposition of an insulating layer.

It is also possible for the further patch antenna, provided in particular for GPS services, not to be provided with its own ground plane, but for the substrate to lie directly on the parasitic box-shaped or box-like patch element of the first patch antenna, in such a way that the parasitic patch element of the first patch antenna simultaneously also forms the ground plane of the further patch antenna.

Finally, it has been found within the scope of the invention that the parasitic patch element, which is formed at least in portions with a circumferential rim or a circumferential wall, can be formed on the lower side and/or on the circumferential rim side of the further patch antenna. In this way, the aforementioned box-shaped or box-like patch element is not actually formed as a separate component, i.e. completely or partially not provided as a separate component, but the corresponding electrically conductive portions of what is referred to as the box-shaped or box-like patch element are formed completely or in part as metallised layers on the corresponding portions of the further patch antenna.

In this case, the parasitic patch element of the primary antenna may be formed completely or in part from a metallised layer on the lower side and/or on the circumferential side walls of the further patch antenna. These steps may be performed during the production of the further patch antenna, specifically in a manner similar to the construction of the patch antenna itself, if an electrically conductive patch plane is applied to the substrate of a patch antenna of this type so as to lie in the transmission direction, and an electrically conductive ground plane in the form of a metal coating on the upper and lower side of the substrate of the patch antenna is applied to the opposite side. In this case, the parasitic further box-shaped or box-like patch element, which in the state of the art is provided above a radiation plane of a patch antenna, would not be present as a physically independent element.

The aforementioned metal coatings on the patch antenna, on the lower side thereof and/or on one or more of the circumferential side faces, need not be constructed over the entire periphery, but may have gaps in the circumferential direction, for example at the corner regions, may be of different heights, and may even be galvanically separated from the ground plane below or from the parasitic patch element below. The aforementioned metal coatings on the side faces may even extend as far as the upper side of the further patch antenna, but should be galvanically separated at that location from the actively fed antenna patch of the further antenna.

The shaping in particular of the further patch antenna, i.e. predominantly the shaping of the substrate, of the lower ground plane which may also simultaneously be the plane of the parasitic patch element of the first patch antenna, but also of the active patch plane provided on the transmission/receiving side, need not necessarily be square or rectangular. This plane may be configured so as to be n-polygonal and may even have further shapings deviating from a regular angular shape. Ultimately, the side walls of the substrate of the additional patch antenna and/or the side walls or side faces, which are provided there at least in portions and which extend away from the first patch antenna, need not necessarily be formed parallel to the axial direction of the patch antenna (i.e. perpendicular to the various ground and/or radiation planes), but may have rounded corners, angular corners etc. In this respect, too, no limitations are given.

The invention is described in greater detail in the following by way of drawings, in which, in particular:

Figure 4:
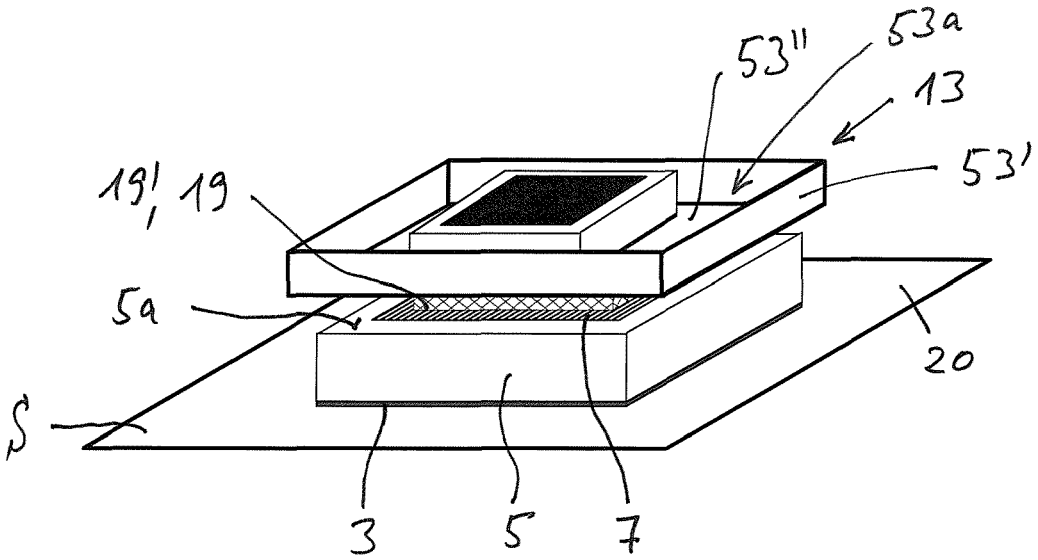
FIG. 4 is a schematic three-dimensional view of the patch antenna arrangement according to the invention with the two individual patch antennae.
Figure 8:
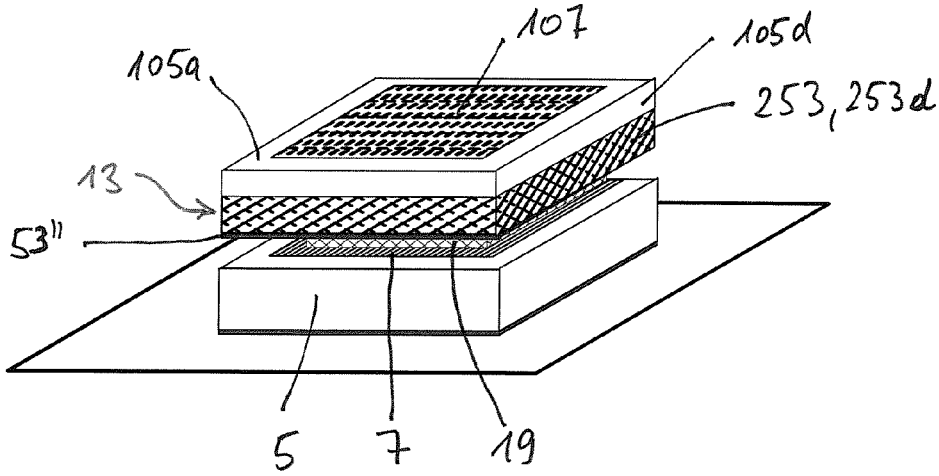
FIG. 8 is a three-dimensional view of the antenna arrangement according to the invention with the two patch antennae based on the antenna shown in a vertical section in FIG. 7.
Figure 14:
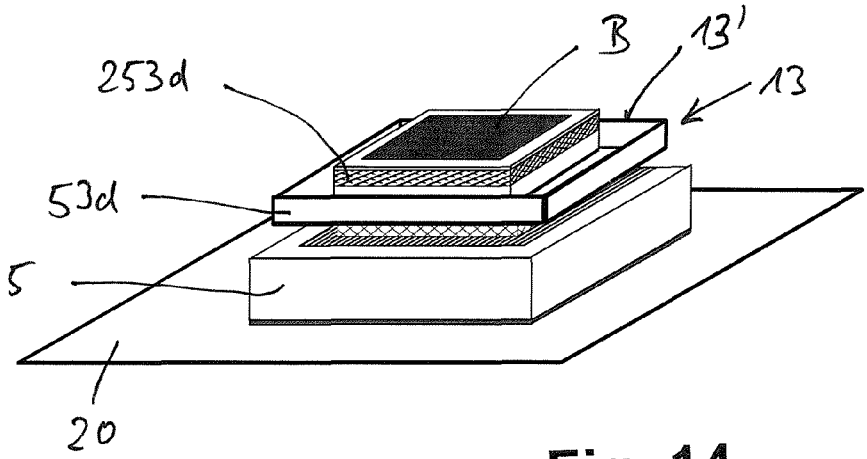
Figure 15:
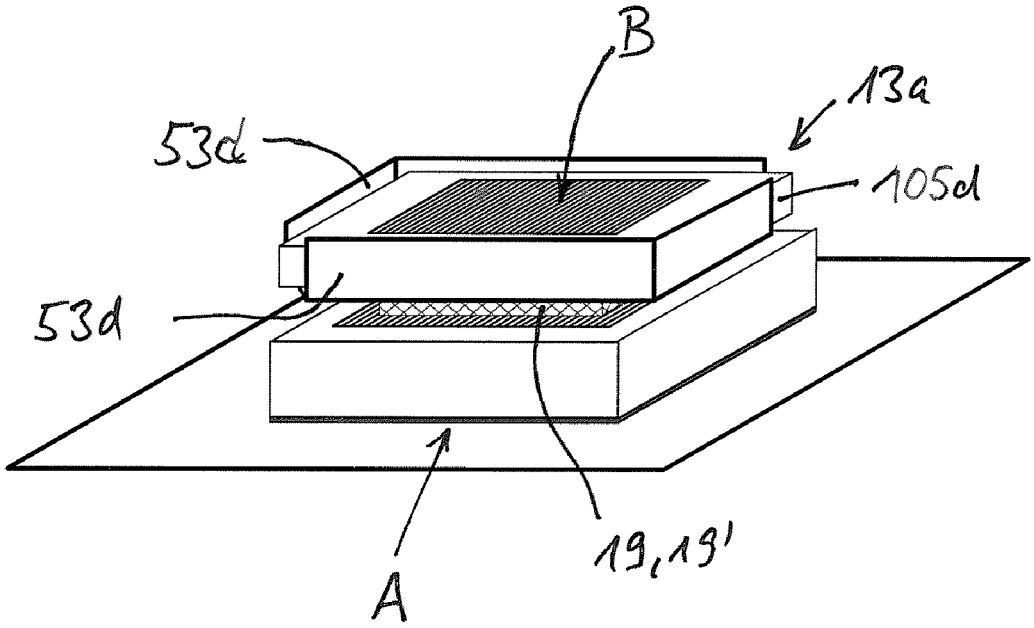

FIG. 14 shows an embodiment varying in particular from FIG. 4 or FIG. 8, in which the parasitic patch arrangement is configured in part so as to be box-shaped or box-like, and partially metallised (electrically conductive) layers are formed, for example, on the circumferential or side walls of the further patch antenna; and FIG. 15 shows a further modified embodiment, in which the box-shaped or box-like electrically conductive patch element is omitted for example in two opposite corner regions, even though the further patch antenna projects over the parasitic patch element in these corner regions.

In the following, reference is initially made to the embodiment of FIGS. 2 to 5, which show a patch antenna which has planes and layers arranged on top of one another along an axial axis Z. A patch element of this type is known in principle from DE 10 2006 027 694 B3, reference being made to the entirety of the disclosure thereof. However, the patch element known from DE 10 2006 027 694 B3 does not have an additional patch antenna.

Figure 1:
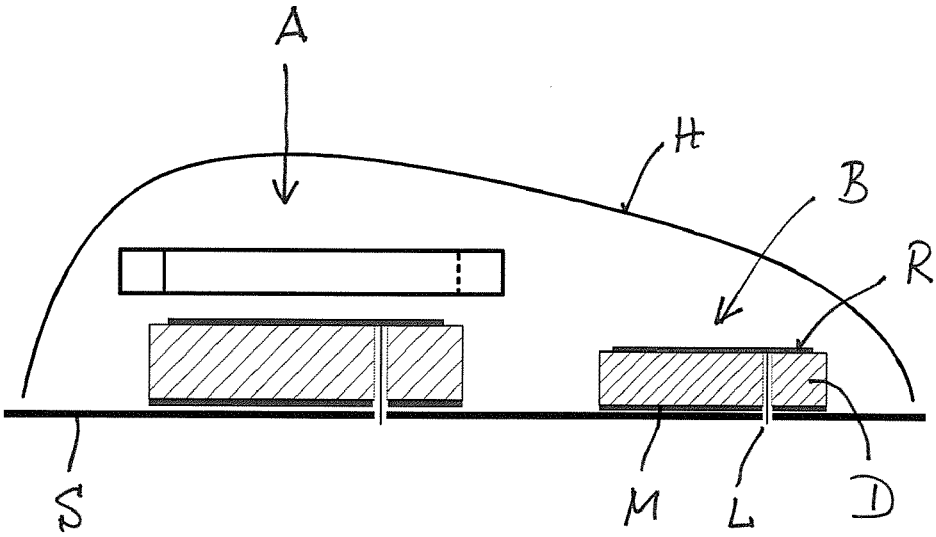
FIG. 1 is a schematic cross-sectional view through an antenna such as may be fitted in particular to the roof of a motor vehicle, using a first patch antenna which is known from the prior art and an adjacently positioned further patch antenna for other services.
Figure 2:
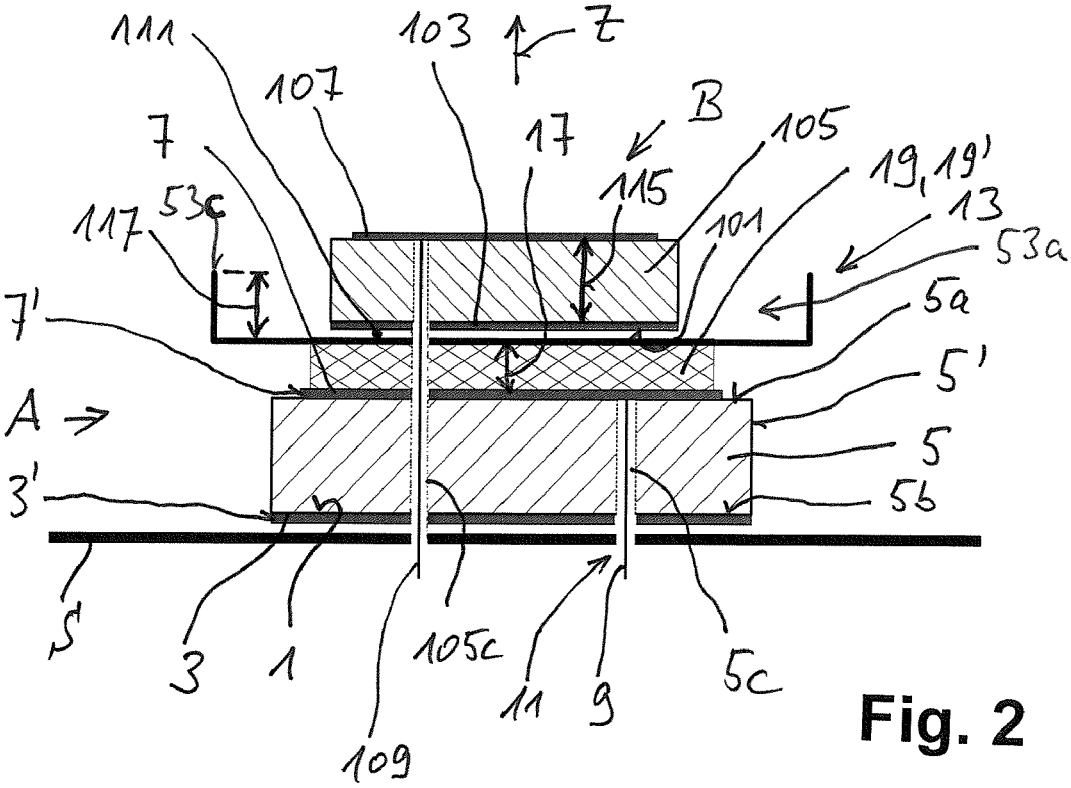
FIG. 2 is a cross-sectional view through an antenna arrangement according to the invention, using a first (primary) and a second (secondary) patch antenna.

It can be seen from the schematic cross-sectional view of FIG. 2 that the patch antenna A has an electrically conductive ground plane 3 on what is known as the lower side or mounting side 1 thereof. Arranged on the ground plane 3 or with a lateral offset therefrom is a dielectric carrier 5, which in a plan view conventionally has an outer contour 5' which corresponds to the outer contour 3' of the ground plane 3. However, this dielectric carrier 5 may also have larger or smaller dimensions and/or be provided with an outer contour 5' which deviates from the outer contour 3' of the ground plane 3. In general, the outer contour 3' of the ground plane may be n-polygonal and/or even provided with curved portions or configured so as to be curved, even though this is unconventional.

The upper side 5*a* and the lower side 5*b* of the dielectric carrier 5 are of a sufficient height or thickness, which generally corresponds to a multiple of the thickness of the ground plane 3. In contrast with the ground plane 3, which approximately consists merely of a two-dimensional plane, the dielectric carrier 5 is thus configured as a three-dimensional body with a sufficient height and thickness.

In a deviation from the dielectric body 5, a different type of dielectric or a different dielectric construction may also be provided, even using air or with a layer of air in addition to a further dielectric body. When air is used as a dielectric, a corresponding carrier means must then of course be provided, for example with stilts, bolts, pillars etc., in order to support and to hold the further parts, which are located above and are still to be explained in the following, of the patch antenna.

Formed on the upper side 5*a* opposite the lower side 5*b* is an electrically conductive radiation plane 7, which again can also be understood approximately as a two-dimensional plane. This radiation plane 7 is electrically fed and excited via a feeder 9, which preferably extends in the transverse direction, in particular perpendicular to the radiation plane 7, from below, through the base (chassis) S, the ground plane 3 and the dielectric carrier 5, in an appropriate hole or an appropriate channel 5*c*.

The internal conductor of a coaxial cable (not shown) is electrogalvanically connected to the feeder 9 and thus to the radiation plane 7 from a terminal 11, which is generally located below and to which the coaxial cable, not shown in greater detail, can be attached. The external line of the coaxial cable (not shown) is electrogalvanically connected to the ground plane 3 located below. Instead of the attached coaxial cable, a microstrip line can also be used and correspondingly connected.

The embodiment of FIG. 2 et seq. discloses a patch antenna which comprises a dielectric 5 and has a square shape in a plan view. This shape or the corresponding contour or outline 5' may however also deviate from the square shape and in general have an n-polygonal shape. Although unconventional, even curved outer boundaries may be provided.

The radiation plane 7 positioned on the dielectric 5 may have the same contour or outline 7' as the dielectric 5 located below. In the embodiment shown, the basic shape is likewise fitted to the outline 5' of the dielectric 5 and formed so as to be square, but has flat portions 7" (only shown in the plan view of FIG. 3) at two opposite ends, which flat portions are formed approximately speaking by omitting an isosceles right-angled triangle. Thus, in general, the outline 7' may also be an n-polygonal outline or contour or even be provided with a curved outer boundary 7'.

The aforementioned ground plane 3, and likewise the radiation plane 7 however, are considered in part as a "two-dimensional" plane, because the thickness thereof is so low that they in effect cannot be considered "three-dimensional bodies". The thickness of the ground plane 3 and the radiation plane 7 is conventionally less than 1 mm, therefore generally less than 0.5 mm, in particular less than 0.25 mm, 0.20 mm or 0.10 mm.

The patch antenna disclosed thus far may for example consist of a patch antenna of the commercially conventional type, preferably of what is known as a ceramic patch antenna with a dielectric carrier layer 5 made of a ceramic material. In accordance with the further description, it results that in addition to the patch antenna disclosed thus far, a patch antenna in the sense of a stacked patch antenna A is further constructed, in which a parasitic patch element 13 is additionally provided above the upper radiation plane 7 (preferably so as to lie perpendicular to said radiation plane 7 and offset at a distance parallel thereto). This parasitic patch element 13 is configured in such a way as to have a three-dimensional structure in contrast to the aforementioned ground plane 3 and the radiation plane 7, with a height and thickness which are different from, i.e. greater than, those of the ground plane 3 or the radiation plane 7.

A carrier means 19 (in particular a dielectric carrier means) which has a thickness or height 17, and which supports and carries the parasitic patch element 13, is preferably used. This dielectric carrier means 19 preferably consists of an adhesive or mounting layer 19', which may be formed as what is known as a double-sided adhesive or mounting layer. Commercially conventional double-sided adhesive tapes or double-sided adhesive foam tapes, adhesive pads or the like, which have an appropriate thickness as specified above, may be used for this purpose. This provides the option of simply fastening and mounting the aforementioned patch element 13 on the upper side of a commercially conventional patch antenna, in particular a commercially conventional ceramic patch antenna, by this means.

The stacked patch antenna A thus described is positioned on a chassis S, shown merely as a line in FIG. 2, i.e. on a base, which is also additionally denoted by the reference numeral 20. This base may for example be the base chassis 20 for a motor vehicle antenna, on which chassis the antenna according to the invention can be installed, optionally in addition to further antennae for other services. The stacked patch antenna A according to the invention may for example be used in particular as an antenna for receiving satellite or terrestrial signals, for example what is known as SDARS. However, no restrictions are placed on the use for other services.

The patch element 13 may for example consist of an electrically conductive, upwardly open box-shaped metal body with a corresponding longitudinal and transverse extent and sufficient height.

Figure 3:
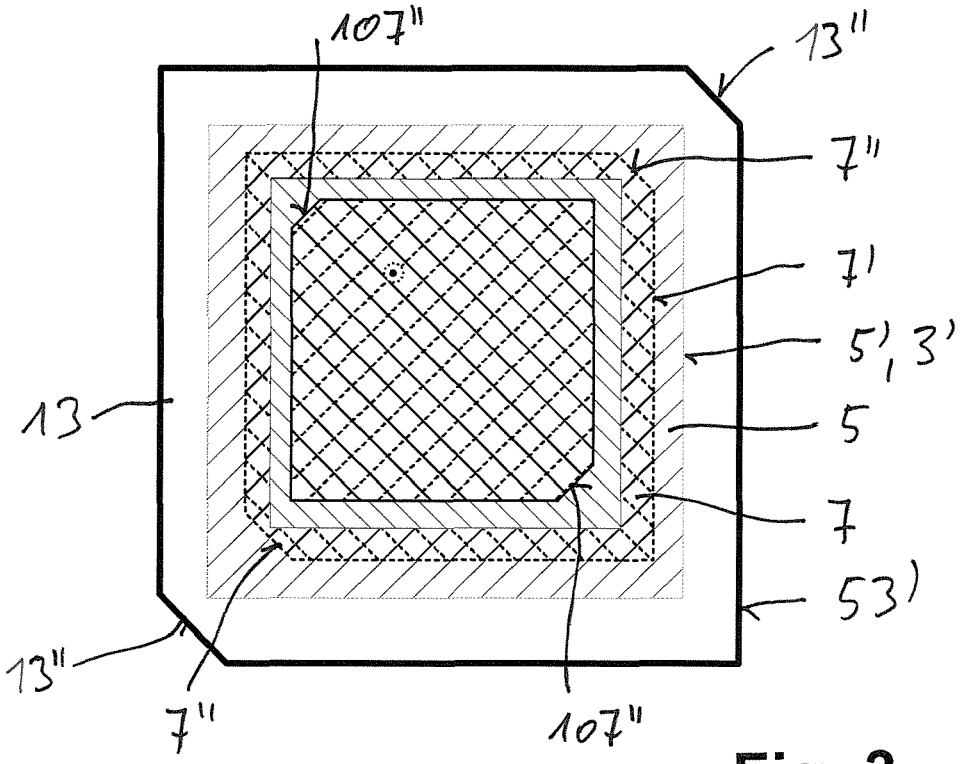
FIG. 3 is a schematic plan view of the embodiment of FIG. 3, additionally showing the significant components, disposed under an upper (parasitic) patch element, of the first patch antenna.
Figure 5:
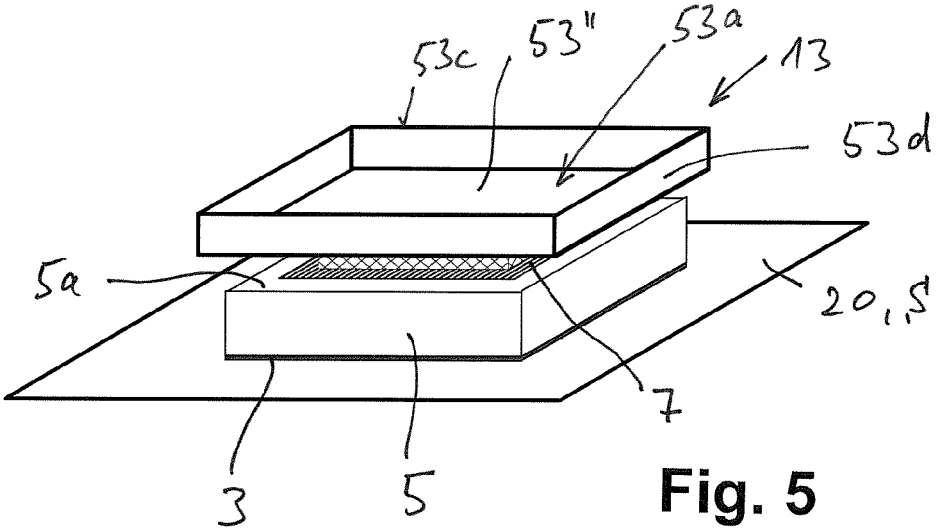
FIG. 5 is a view corresponding to FIG. 4 but without the second patch antenna.

As can be seen from the three-dimensional view of FIGS. 4 and 5, this patch element 13 may have a rectangular or square construction with the corresponding outline 53', but is not limited to this shaping. Thus, in FIG. 4 the upper patch element 13 is shown as rectangular or square in a plan view, including the circumferential rims or walls, which will later be further discussed. The plan view in FIG. 3 shows that the parasitic patch element 13 may also be shaped differently therefrom and may have an n-polygonal form for example. For this reason, FIG. 3 shows that the patch element 13 can be provided with flat portions 13", for example at two opposite corner points, which are disposed for example adjacent to the flat portions 7" of the upper active radiation plane 7 of the patch antenna A.

In the embodiment shown, the patch element 13 has a longitudinal extent and a transverse extent which on the one hand are greater than the longitudinal and transverse extent of the radiation plane 7 and/or on the other hand are also greater than the transverse and longitudinal extent of the dielectric carrier 5 and/or of the ground plane 3 disposed below.

As can be seen from the figures, the parasitic patch element, which rests or is fastened on the carrier means 19 in the manner of an upwardly open box, comprises a base plane or central plane 53", which in the embodiment shown is provided with a circumferential rim or a circumferential web 53*d* (thus in general with an appropriate raised portion 53*d*), which rises transversely, in particular perpendicularly, from the plane of the base plane 53", which is also parallel to the ground plane. A patch element 13 of this type may for example be produced by cutting and edging procedures from an electrically conductive metal sheet, it being possible for the circumferential webs 53*d* to be connected to one another in the corner regions electrically/galvanically, for example by soldering (it further being possible for more recesses to be formed in the central portion 53", although this will not be discussed further in the following).

Above this secondary patch element 13 is disposed, as is shown in the further figures, a second patch antenna B. The second patch antenna B is dimensioned, in terms of the length and width thereof, in such a way that the measurements thereof are for example at least slightly smaller than the free internal longitudinal and transverse extent between the circumferential webs 53*d* of the parasitic patch element 13. This specifically provides the option of burying the patch antenna B in the interior 53*a* of the patch element 13 to various extents. In other words, the lowest level, i.e. the lowest boundary plane 101, is located in the interior 53*a* of the parasitic patch element 13, i.e. below the upper boundary plane 53*c*, which is defined by the upper circumferential edges of the webs, rims or outer walls 53*d* of the parasitic patch.

The second patch antenna B also in turn comprises a substrate (dielectric body) 105 comprising an upper side 105*a* and a lower side 105*b*, the active radiation plane 107 of the second or secondary patch antenna B being formed so as to lie in the transmission/receiving direction (i.e. remote from the patch antenna A) as an electrically conductive plane on the upper side 105*a* of the substrate 105, and the associated second ground plane 103 of the second patch antenna B being provided so as to lie facing the patch antenna A (i.e. on the lower side 105*b*).

It can be inferred from the drawings that a further channel or a further hole 105*c* is provided transverse, and in particular perpendicular, to the patch radiation planes (i.e. in the axial Z-direction of the whole antenna arrangement). This channel extends through the chassis 20, through the first or primary patch antenna A (i.e. through the ground plane thereof, the dielectric body and the radiation plane above), through the carrier means 19 attached thereto and the parasitic patch element 13, through an optionally following carrier layer for the second patch antenna B, and through the second ground plane 103 of the patch antenna B and through the dielectric carrier 105 up to the second radiation plane 107 above, i.e. to the second radiation plane 107 of the second patch antenna B.

Disposed on the lower side of the chassis 20 is a coaxial terminal, in such a way that the radiation plane 107 is fed via a feeder 109 extending in the channel. The external line of a coaxial connection cable is galvanically connected to the ground plane 3 at the terminal. A microstrip connection cable may of course also be provided in this embodiment instead of a coaxial connection cable.

In the embodiments disclosed thus far, the height 115 of the second patch antenna B (including a support and/or fastening and/or adhesive layer 111 optionally located on the lower side of the ground plane 103 adjacent to the upper side of the parasitic patch element 13) is greater than the height 117, i.e. greater than the circumferential rims 53*d* of the parasitic patch element 13. The height of the patch element may however also be the same height as the circumferential rims 53*d* of the parasitic patch element 13.

Figure 6:
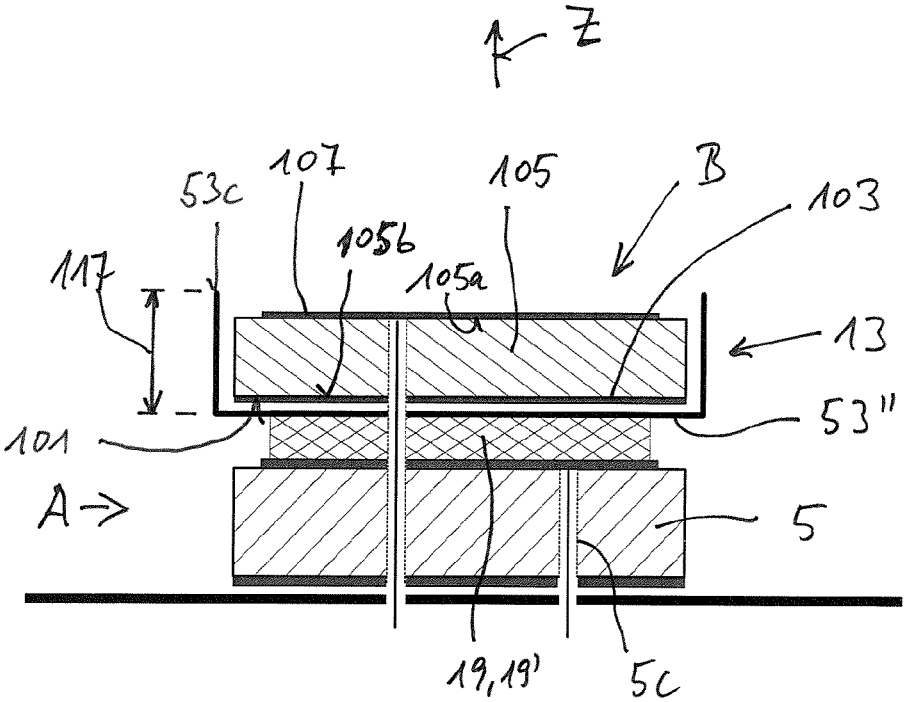
FIG. 6 is a cross-sectional view comparable with the cross-sectional view of FIG. 2 based on modified embodiment.

FIG. 6 shows that the circumferential rims 53*d* of the parasitic patch element 13 may even be higher than the height of the second patch antenna B in such a way that the second patch antenna B is fully buried in the interior 53*a* of the parasitic patch element 13. Moreover, FIG. 6 shows in contrast to FIG. 2, that the longitudinal and transverse extent of the further patch antenna B extending in relation to the Z axis are dimensioned so as to be greater and can at least almost completely fill out the interior of the parasitic patch element 13.

Figure 7:
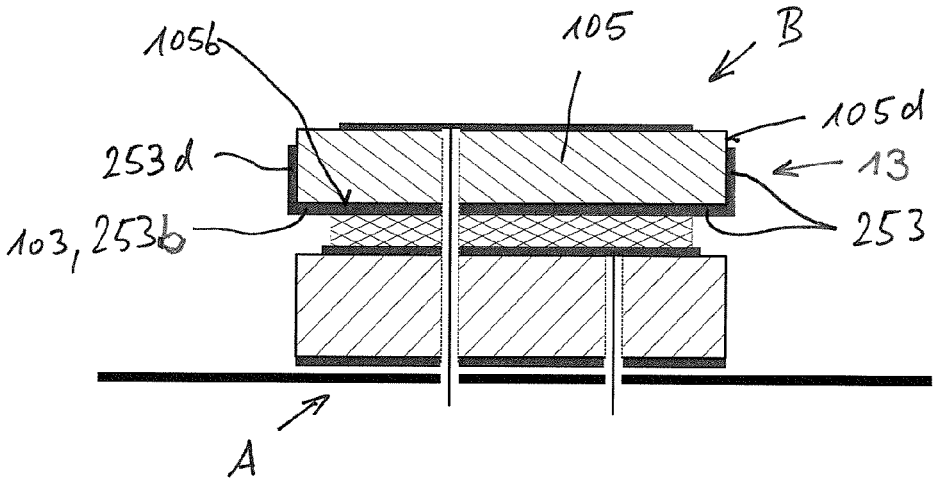
FIG. 7 is a further cross-sectional view comparable with the views of FIG. 2 or 6 based on a further modified embodiment.

The sectional view of FIG. 7 shows that the parasitic patch element 13 (which serves to shape the beam from the patch antenna A) is now connected directly to the second patch antenna B. The upper patch element 13 of the first or primary patch antenna A may for example consist of a metallised layer 253, which is formed directly on the surface of the second patch antenna B. The application of this metallised layer may be carried out during the production of the second patch antenna B, much as the patch plane or the ground plane or the metal coating on the upper or lower side of the second patch antenna may correspondingly be applied during the production thereof. The parasitic patch element 13 is thus no longer present as a physically independent element, but is a fixed component of the second patch antenna B.

It can thus be seen from FIGS. 7 and 8 that even the separate lower ground plane 103 of the second patch antenna B has been dispensed with, in such a way that the metallised layer 253 on the lower side 105*b* of the dielectric carrier 105 replaces and/or forms the ground plane 103 of the second patch antenna B as a layer 253*d* and this metallised layer 253 simultaneously also forms the parasitic patch element 13. In this embodiment the metallised layer 253 is thus also formed, for at least part of the height thereof, on the circumferential rims 105*d*, i.e. on the outer surfaces 105*d*, of the second patch antenna B, and there covers the dielectric carrier 105. In this case the lower layer 253*b*, which is formed on the dielectric carrier 105 of the second patch antenna B on the lower side 105*b*, is galvanically connected completely or at least in portions to the metallised layers 253*d*, which are provided on at least part of the height of the outer circumferential surfaces.

Figure 9:
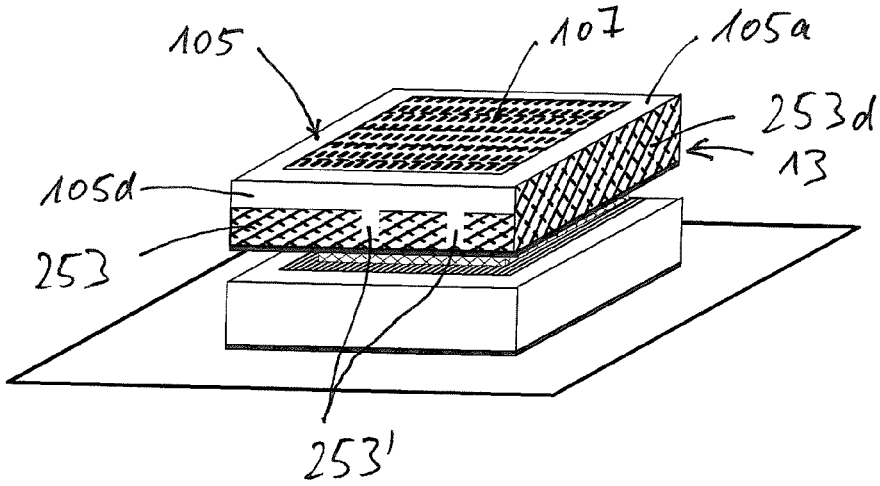
FIG. 9 shows a further modification, based on the patch antenna arrangement according to the invention which is shown in three dimensions in FIG. 8.

It can be seen from the view of FIG. 9 that the metal coatings 253, which are formed on the outer sides 105*d* of the second dielectric carrier 105, i.e. in the circumferential direction on the second patch antenna B, need not always be of the same height. It can be seen for example that the metallised layer 253*d*, which is formed on one circumferential edge 105*d*, comprises recesses 253', in such a way that a metallised layer with a low height remains, whereas on the outer side 105*d*, on the right in FIG. 9, a metallised layer which extends as far as the upper side 105*a* of the substrate 105 is formed on the carrier 105.

Figure 10:
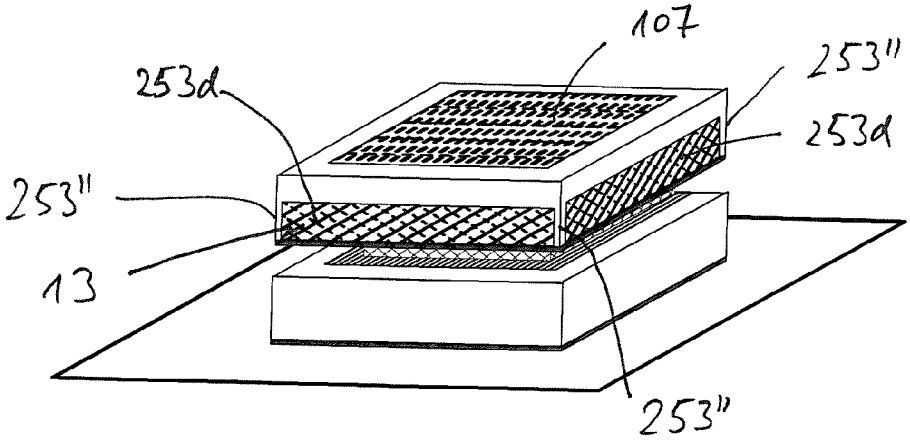
FIG. 10 is a three-dimensional view of a further modification to FIG. 9.

In the variant of FIG. 10, it is shown that the circumferential metallised layer 253*d* need not be formed over the entire periphery, but the individual metallised layers 253*d* on the circumferential rims 105*d* of the dielectric carrier 105 may have gaps 253", which are formed up to the level of the lower side 105*b* on the dielectric carrier 105. These gaps or recesses 253" are provided in the corner regions of the substrate in the variant of FIG. 10.

Figure 11:
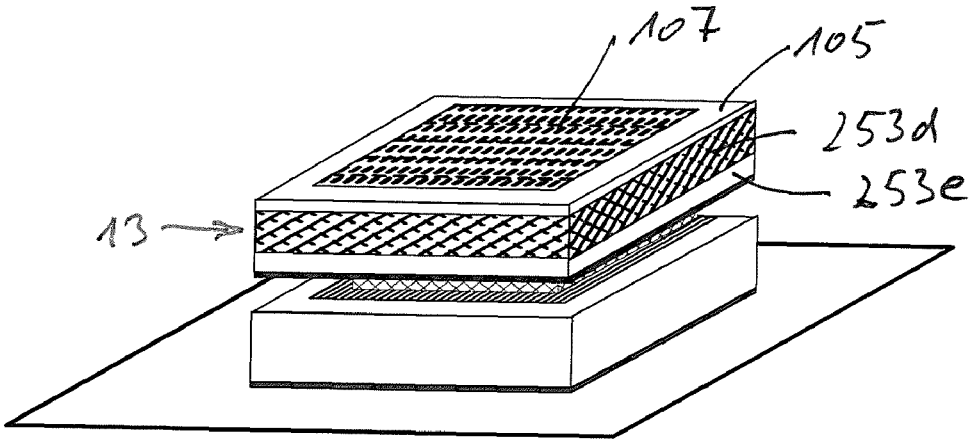
FIG. 11 is a further modification of the three-dimensional views shown in FIGS. 9 and 10.

A further variant shown in FIG. 11 demonstrates that the circumferential metallised layers 253*d*, which are formed on the dielectric carrier 105, are even separated from the metallised layer 253*b*, which is formed on the lower side 105*a* of the dielectric carrier 105, by a separation portion 253*e*, i.e. are galvanically separated in this embodiment. In the corner regions of the substrate, the metallised layers 253*d* are circumferentially galvanically connected in this embodiment.

Figure 12:
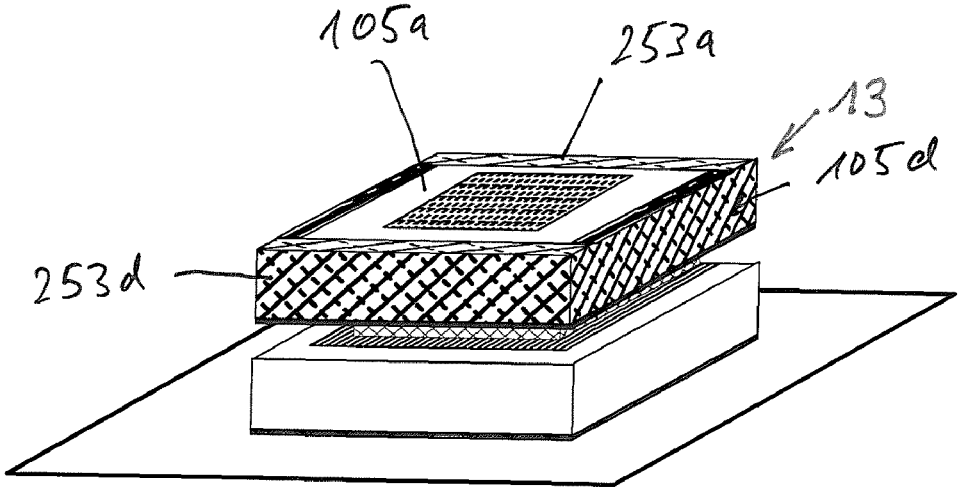
FIG. 12 is a three-dimensional view of a further modification, in particular to the embodiment shown in FIG. 8.

In the embodiment of FIG. 12, it can be seen that the metallised layers 253 extend not only on the lower side 105*b* and on the circumferential edge surfaces or outer surfaces 105*d*, but also continue from the outer rim 105*d* for a particular distance on the upper side 105*a* of the dielectric carrier 105, but end at a distance before the upper radiation plane 107 of the second patch antenna B, in such a way that the radiation plane 107, provided on the upper side 105*a* of the substrate 105, and the metal coatings 253 are galvanically separated. In the embodiment shown, the electrically conductive layer 253*a*, which is formed on the upper side 105*a* of the substrate 105, is galvanically connected to the electrically conductive layers 105*d* on the outer periphery of the substrate 105.

Figure 13:
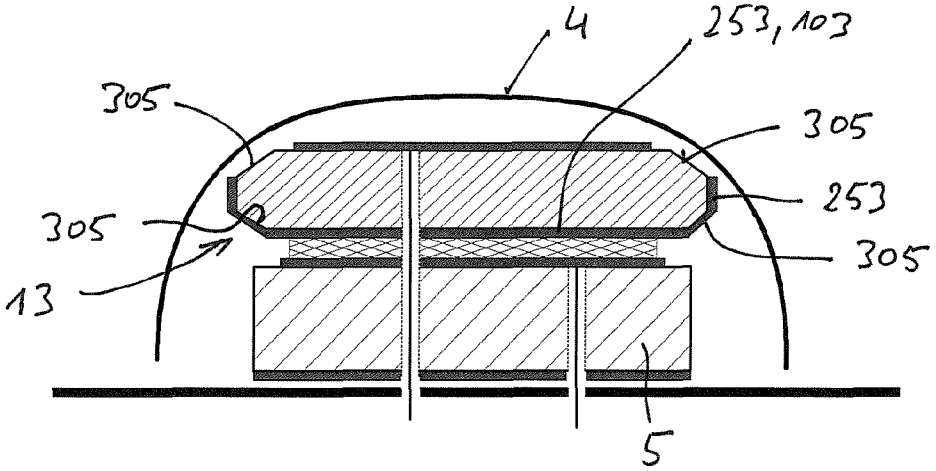
FIG. 13 is a cross-sectional view of a further modified embodiment to clarify the different substrate cross-sections for the further patch antenna.

The cross-sectional view of FIG. 13 is intended to show that the dielectric carrier 105 of the second patch antenna B also need not necessarily have a rectangular form in the vertical cross-section (perpendicular to the individual radiation planes), but chamfers 305 may be formed on the upper and lower side or curved elements may be formed on the substrate 105. In the case of correspondingly applied metallised layers 253, these layers are formed in accordance with the corresponding outer contour of the substrate.

For the sake of completeness, it should further be noted that the dielectric carrier 5, the associated ground plane 3 below and the radiation plane 7, located above opposite the ground plane, of the first patch antenna A, as well as the dielectric carrier 105 of the second patch antenna B and the optionally provided ground plane 103, as well as the associated radiation plane 107, also need not necessarily have a square or rectangular shape, but may be provided so as to be quite generally n-polygonal or even have curved edge surfaces. From the embodiments shown, in particular with reference to FIG. 3, it can be seen that for example the radiation plane 7 is provided with flat portions 7" in two diagonally opposite corner regions (i.e. formed on the first patch antenna A), whilst corresponding flat portions 107", formed in two diagonally opposite corner regions, may also be formed in relation to the radiation plane 107 on the second patch antenna B. These two flat portions 107" of the second patch antenna B are formed so as to lie at 90° to the flat portions 107" of the first patch antenna A. Likewise, the parasitic patch element may even, for example, be provided with opposite flat portions 13" (as shown in FIG. 3), in a deviation from FIGS. 2 and 4. The dielectric carriers 5 and 105 may also be formed with irregular contours, in particular opposite flat portions, avoiding corresponding corner regions.

In the following, reference is made to yet another embodiment in accordance with FIG. 14, which ultimately shows an embodiment which can be described as a combination of the embodiment of FIG. 4 and of FIG. 11.

This is because, in the embodiment of FIG. 14, it can be seen that an upper parasitic patch arrangement 13 is provided, similar to the one disclosed in FIG. 4 and the other embodiments. However, the further patch antenna B additionally comprises, on the circumferential side walls thereof, i.e. on the outer circumferential surface 105*d*, metallising portions, i.e. metal coatings 253*d*, which in this embodiment extend only to a partial height (but may also be formed over the entire height of the further patch antenna B). In the embodiment shown, the metal coatings 253*d* thus extend to a height which projects, at least for a partial height, over the circumferential edge 13' of the upper patch arrangement 13, when viewed precisely from the side, but also end below this height. This metal coating 253*d* may also have portions of a different height along the circumferential surface, with gaps, in part with connections to a metal coating formed on the lower side of the further patch antenna B, etc. Further limitations are therefore likewise not given here.

FIG. 15 shows that for example the parasitic patch arrangement 13 under discussion may be provided, for example in two opposite corner regions, with flat portions, recesses or what are known as omissions 13", as has already been indicated in a plan view in FIG. 3 and in a three-dimensional view in FIG. 15. In other words, in this embodiment the circumferential rims, walls or webs 53*d* are also interrupted by the flat portions 13" in these corner regions, it being possible for the further patch antenna B, disposed in this box-shaped or box-like parasitic patch element 13, to project outwards in these corner regions over the opening regions 13*a* thus created, between two adjacent rim portions 53*d*, in such a way that the circumferential rim 105*d* of the further patch antenna B is visible.

The invention claimed is:

1. Multilayer antenna of a planar construction, comprising:

a first patch antenna with a plurality of planes and/or layers which are arranged along an axial axis with or without a lateral offset from one another, comprising:

a first electrically conductive ground plane, a first conductive radiation plane arranged so as to lie offset transverse to the first ground plane and extended parallel thereto, a first dielectric carrier arranged between the first ground plane and the first radiation plane at least for a partial height and/or a partial region, wherein the first radiation plane is electrically connected to an electrically conductive feeder, a first carrier provided directly or indirectly on the opposite side of the first radiation plane from the first ground plane, an electrically conductive parasitic patch arrangement, provided on the opposite side of the first carrier from the first radiation plane, wherein the first carrier has a thickness or height smaller than a thickness or height of the parasitic patch arrangement, wherein the parasitic patch arrangement is configured so as to be box-shaped or box-like and/or comprises, at least in regions, circumferential raised portions, rim portions, web portions or wall portions, which extend so as to proceed transversely from a base portion or central portion of the parasitic patch arrangement, specifically away from the first radiation plane, and a second patch antenna comprising a second dielectric carrier and a second radiation plane provided above the base portion or central portion of the parasitic patch arrangement, the second radiation plane being provided on the upper side, opposite the base portion or central portion of the second dielectric carrier, and the second patch antenna buried at least in part in the parasitic patch arrangement, is formed, completely or in part, as electrically conductive planes, which are provided on the second patch antenna at least in partial regions on the circumferential edge surface or outer surface thereof.

2. The antenna according to claim 1, wherein the parasitic patch arrangement comprises raised portions, rims and/or webs, which extend transversely away from the base portion or central portion and the height of which is greater than or equal to the height of the second patch antenna.

3. The antenna according to claim 1, wherein the parasitic patch arrangement comprises raised portions, rims, webs and/or walls and/or electrically conductive planes, which extend transversely away from the base portion or central portion and the height of which is less than or equal to the height of the second patch antenna.

4. The antenna according to claim 1, wherein a second ground plane is formed on the lower side of the second dielectric carrier of the second patch antenna.

5. The antenna according to claim 4, wherein a second carrier of a non-conductive material, in the form of a double-sided adhesive layer, is provided between the second ground plane and the base portion or central portion of the parasitic patch arrangement.

6. The antenna according to claim 1, wherein the lower side of the second dielectric carrier is arranged directly on the upper side of the base portion or central portion of the parasitic patch arrangement.

7. The antenna according to claim 1, wherein the longitudinal and/or transverse extent of the second patch antenna parallel to the base portion or central portion of the parasitic patch arrangement has a smaller dimension than the clear internal dimension in the longitudinal and transverse direction between the raised portions, rims, webs and/or electrically conductive planes of the parasitic patch arrangement.

8. The antenna according to claim 1, wherein the base portion or central portion of the parasitic patch arrangement is provided as an electrically conductive layer or metal coating directly on the lower side of the second dielectric carrier of the second patch antenna.

9. The antenna according to claim 1, wherein the raised portions, rims, webs and/or walls of the parasitic patch arrangement are formed as electrically conductive planes or metal coatings on the outer surfaces on the second dielectric carrier of the second patch antenna.

10. The antenna according to claim 9, wherein the electrically conductive layers or metal coatings which are formed on the outer circumferential surfaces of the second dielectric carrier extend to a partial height or to the full height thereof.

11. The antenna according to claim 9, wherein the electrically conductive planes or metal coatings which are formed on the outer circumferential surfaces of the second dielectric carrier are galvanically separated from the electrically conductive layers or metal coatings which are formed on the lower side of the second dielectric carrier.

12. The antenna according to claim 1, wherein electrically conductive layers or metal coatings are provided on the upper side of the second dielectric carrier so as to be separated from the radiation plane provided on the upper side, and are galvanically connected to the electrically conductive planes or metal coatings which are formed on the outer walls of the second dielectric carrier.

13. The antenna according to claim 1, wherein the radiation plane of the first patch antenna, the radiation plane of the second patch antenna, and/or the second dielectric carrier of the second patch antenna have mutually opposed flat portions.

14. The antenna according to claim 1, wherein when viewed from the side, parallel to the first ground plane, the metal coating, which is formed at least on partial regions of the circumferential edge surfaces or outer surfaces of the second patch antenna, overlaps the edges or rims, extending out from the first ground plane, of the box-shaped or box-like parasitic patch arrangement.

15. The antenna according to claim 1, wherein the box-shaped or box-like parasitic patch arrangement is provided with a recess in one or in at least two opposite corner regions the corners of the second patch antenna protruding freely in the opposite corner regions.

* * * * *